United States Patent [19]

Shindou et al.

[11] Patent Number: 5,000,828

[45] Date of Patent: Mar. 19, 1991

[54] PROCESS FOR PRODUCING ONE-SIDE ELECTROGALVANIZED STEEL SHEET WITH DISTINGUISHED SUSCEPTIBILITY TO PHOSPHATE SALT TREATMENT AND DISTINGUISHED APPEARANCE ON THE NON-ELECTROGALVANIZED SIDE

[75] Inventors: Yoshio Shindou; Taketoshi Taira; Shirou Fujii, all of Kimitsu, Japan

[73] Assignee: Nippon Steel Corporation, Tokyo, Japan

[21] Appl. No.: 505,657

[22] Filed: Apr. 6, 1990

[30] Foreign Application Priority Data

Apr. 12, 1989 [JP] Japan ..... 1-90690

[51] Int. Cl.[5] ..... C25D 7/06

[52] U.S. Cl. ..... 204/28; 204/34; 204/145 R

[58] Field of Search ..... 204/28, 34, 145 R

[56] References Cited

U.S. PATENT DOCUMENTS 4,522,892 6/1985 Shindou ..... 204/28

FOREIGN PATENT DOCUMENTS 58-133395 8/1983 Japan .
58-181889 10/1983 Japan .
59-96292 6/1984 Japan .
59-126788 7/1984 Japan .
60-43499 3/1985 Japan .
60-200974 10/1985 Japan .

*Primary Examiner*—T. M. Tufariello
*Attorney, Agent, or Firm*—Wenderoth, Lind & Ponack

[57] ABSTRACT

A one-side electrogalvanized steel sheet with a distinguished susceptibility to a phosphate salt treatment and a distinguished appearance on the non-electrogalvanized side is produced by subjecting the non-electrogalvanized side of a steel sheet after one-side electrogalvanization in a galvanizing bath to an electrolytic peeling treatment using the non-electrogalvanized side of the one-side electrogalvanized steel sheet as an anode in an electrolytic peeling treatment bath containing 5 to 30% by weight of sodium sulfate as an electroconductive agent and at least 0.1% by weight of boric acid as a pH-controlling agent at a pH adjusted to a range of 5.0 to less than 9.0 as a posttreatment of the non-electrogalvanized side.

8 Claims, 1 Drawing Sheet

PROCESS FOR PRODUCING ONE-SIDE ELECTROGALVANIZED STEEL SHEET WITH DISTINGUISHED SUSCEPTIBILITY TO PHOSPHATE SALT TREATMENT AND DISTINGUISHED APPEARANCE ON THE NON-ELECTROGALVANIZED SIDE

BACKGROUND OF THE INVENTION

1. Field of the Invention

This invention relates to a process for producing a one-side electrogalvanized steel sheet and particularly to a posttreatment process for improving the susceptibility of the non-electrogalvanized side of one-side electrogalvanized steel sheet to a dip-type phosphate salt treatment, a spray-type phosphate salt treatment or the like.

In the present invention, a one-side electrogalvanized steel sheet means a steel sheet whose one side is electrogalvanized with zinc or alloy composed mainly of zinc or whose one side is subjected to a dispersive or composite plating, and concretely it means a steel sheet whose one side is electrogalvanized with a zinc system such as Zn-Ni system, Zn-Ni-Co system, Zn-Fe system, Zn-Ni-Fe system, Zn-Ni-Fe-Cr system, Zn-Mn system, Zn-Mg system, Zn-Bi system, Zn-Cr system, Zn-Ni-Cr system, Zn-Ni-$SiO_2$ system, Zn-Ni-Cr-$SiO_2$ system or Zn-Ni-$BaCrO_4$ system.

2. Prior Art

One-side electrogalvanized steel sheets are used mainly as outer casings for automobiles, and generally it is a usual practice to apply a phosphate salt treatment to the non-electrogalvanized side of a one-side electrogalvanized steel sheet as a coating treatment before coating of the non-electrogalvanized side with a paint.

In the phosphate salt treatment, it is necessary to clean the non-electrogalvanized side in a well known manner to bring the non-electrogalvanized side into such a state as not to prevent nuclear generation and growth of crystals in chemical conversion coating. However, the non-electrogalvanized side of the one-side electrogalvanized steel sheet is corroded with the galvanizing solution in the process for one-side electrogalvanization and as a result the corrosion products formed on the surface inhibit the nuclear generation, etc. of crystals in the chemical conversion coating. In order to obtain a good chemical conversion coatability on the non-electrogalvanized side, it is thus necessary to prevent the formation of the corrosion products or remove the formed corrosion products.

The following procedures have been proposed to solve these problems.

A process for removing corrosion products formed on the non-electrogalvanized side by a mechanical means, for example, by grinding with a brush, etc. after the one-side electrogalvanization [Japanese Patent Application Kokai (Laid-open) Nos. 59-126788 and 60-43499], where the non-electrogalvanized side has scars due to the grinding with a brush and there is still a problem on the appearance.

A process for treating the non-electrogalvanized side with an aqueous oxalic acid solution after the one-side electrogalvanization [Japanese Patent Application Kokai (Laid-open) No.60-200974], where the process is effective for preventing the non-electrogalvanized side from discoloration, but fails to remove a trace amount of galvanization metals such as Zn, etc. deposided on the non-electrogalvanized side during the one-side electrogalvanization, and thus the improvement effect on the susceptibility to the phosphate salt treatment is not satisfactory.

A process for applying a peeling treatment to the non-electrogalvanized side by electrolysis using the non-electrogalvanized side as an anode, for example, using the non-electrogalvanized side of one-side electrogalvanized steel sheet 1 as anode in an electrolytic treatment tank 9 as shown in FIG. 2, after the one-side electrogalvanization [Japanese Patent Application Kokai (Laid open) Nos. 58-133395 and 59-96292]. In FIG. 2, the non-electrogalvanized side of one-side electrogalvanized steel sheet is counterposed to an electrode 15, numeral 16 is press rolls and numeral 17 is electroconductive rolls. The process for applying the peeling treatment is satisfactory in that a good chemical conversion coating is obtained in a spray-type chemical conversion treatment which has been hitherto used by automobile makers. However, it is not satisfactory in a dip-type chemical conversion treatment which has been recently increased to a great degree. That is, since the process for applying the peeling treatment does not specify a combination of the concentration of agent, which is necessary for ensuring the electroconductivity in the treating bath, and pH-controlling agent, the performance of the treating bath is unstable in peeling by electrolysis. This results in problems such that the process cannot produce a steel sheet with a good appearance of the peeled surface and a good performance in the dip-type chemical conversion treatment.

A process for applying a peeling treatment to the non-electrogalvanized side by electrolysis using the non-electrogalvanized side as an anode in a phosphoric acid-based bath after the one-side electrogalvanization [Japanese Patent Application Kokai (Laid-open) No. 58-181889], where the pH stability is improved by using phosphoric acid which is a weak acid, and a steel sheet with a comparatively better susceptibility to a phosphate salt treatment can be obtained, but there is an environmental pollution problem due to an inevitable discharge of waste phosphoric acid-based bath in the actual operation when the peeling bath is renewed.

SUMMARY OF THE INVENTION

As a result of extensive studies on ba bath composition in a process for applying a peeling treatment by electrolysis using the non-electrogalvanized side of one-side electrogalvanized steel sheet as an anode to solve the problems of the prior art, the present inventors have found a process for producing a one-side electrogalvanized steel sheet with a distinguished susceptibility to a phosphate salt treatment and a distinguished appearance on the non-electrogalvanized side.

An object of the present invention is to provide a process for producing a one-side electrogalvanized steel sheet with a distinguished appearance and a distinguished susceptibility to a dip-type phosphate salt treatment, a spray-type phosphate salt treatment or the like on the non-electrogalvanized side.

The object of the present invention can be attained by a process for producing a one-side electrogalvanized steel sheet by applying a posttreatment to the non-electrogalvanized side after the one-side electrogalvanization in a galvanizing bath, which comprises applying to the non-electrogalvanized side a peeling treatment by electrolysis using the non-electrogalvanized side as an anode in an electrolytic treatment bath containing 5 to 30% by weight of sodium sulfate as an electroconductive agent and at least 0.1% by weight, preferably 0.5 to 10% by weight, of boric acid as a pH-controlling agent and having a pH adjusted to a range of 5.0 to less than 9.0, preferably a range of 5.2 to 7.5, where the electrolytic treatment bath may further contain an organic acid as a chelating agent. It is preferable that the pH is adjusted to a predetermined pH value in a range of 5.0 to less than 9.0, preferably a range of 5.2 to 7.5 in accordance with the desired product. The term "a predetermined pH value" means in the present specification that a pH value or a pH scope such that the good pH stability is attained.

DETAILED DESCRIPTION OF THE INVENTION

Figure 1:
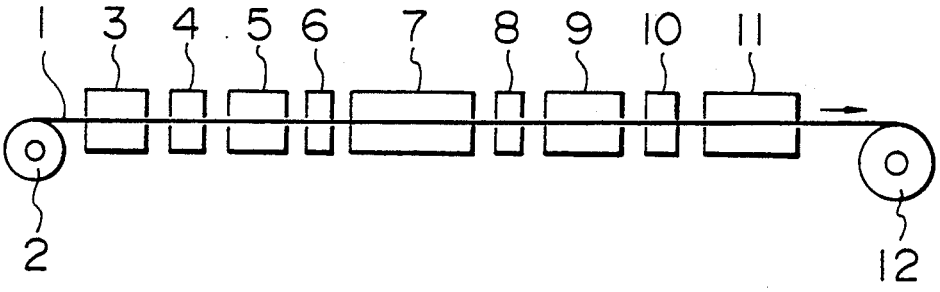
FIG. 1 is a schematic view of a production line of one-side electrogalvanized steel sheet according to the present invention.

Sodium sulfate is selected in the present invention as an electroconductive agent in the electrolytic treatment bath, because it has a large effect on the improvement of the bath electroconductivity as a strong electrolytic salt, and when the non-electrogalvanized side is subjected to a peeling treatment by electrolysis using the non-electrogalvanized side as an anode, sodium sulfate has a less dissolution of the non-electrogalvanized steel matrix than in the case of strong electrolytic salts containing elements of halogen system such as sodium chloride, etc. The reason why the concentration of sodium sulfate is limited to at least 5% by weight is that below 5% by weight, the electroconductivity is not satisfactory and the performance of peeling the surface of the steel sheet by electrolysis is lowered, so that the effect on the improvement of the chemical conversion treatment cannot be obtained. The reason why the concentration of sodium sulfate is limited to not more than 30% by weight is that above 30% by weight, the performance of peeling the surface of the steel sheet by electrolysis is too high to produce a good appearance of the peeled surface.

Boric acid is selected in the present invention as a pH-controlling agent, because when only a strong electrolytic salt is added to the electrolytic treatment bath, the pH stability of the electrolytic treatment bath is not satisfactory during the peeling treatment by electrolysis using the non-electrogalvanized side as an anode and thus a weak electrolytic salt is further added thereto to give the treatment bath a pH buffer action. The preferable range of the concentration of boric acid is at least 0.1% by weight, preferably 0.5 to 10% by weight. The reason why the concentration of boric acid is limited to not more than 10% by weight is that above 10% by weight, it is liable to result in problems such as the occurrence of sludge in the electrolytic treatment bath and the like.

The reason why pH is adjusted to a range of 5.0 to less than 9.0 is that below pH 5.0, the solubility of the steel matrix on the non-electrogalvanized side of the steel sheet is increased and no improvement of the susceptibility to the phosphate salt treatment is expected, and above pH 9.0 the peelability of a trace amount of galvanizing metals such as Zn, etc. deposited on the non-electrogalvanized side during the one-side electrogalvanization is lowered.

An organic acid is selected in the present invention as a chelating agent, because it can improve the appearance of the non-electrogalvanized side after the peeling treatment. Its mechanism seems to be as follows: iron ions dissolved out of the steel matrix on the non-electrogalvanized side of the steel sheet during the peeling treatment keep to stay on the non-electrogalvanized side of the steel sheet even after the peeling treatment by electrolysis using the non-electrogalvanized side as an anode to form hydroxides or oxides, which form a yellow or brown discolored film, causing a poor appearance (the discoloration will be hereinafter referred to as "blackening". Since an organic acid, as added thereto, forms a chelate with the iron ions and thus the iron ions can be readily removed from the steel sheet surface by water washing after the peeling treatment, it is considered that it becomes possible to prevent formation of blacked film. Effective organic acids include organic acids containing a carbonyl group, for example, citric acid, tartaric acid, oxalic acid, formic acid, lactic acid, etc. The preferable range of the concentration of the organic acids is 0.1 to 20.0% by weight.

A current density for electrolysis using the non-electrogalvanized side of the steel sheet as an anode is preferably 2 to 200 $A/dm^2$. At a current density of 2 $A/dm^2$ or more, the appearance is improved, but below 2 $A/dm^2$, the improvement is hard to obtain. Thus a current density of 2 $A/dm^2$ or more is required. As to the upper limit to the current density, not more than 200 $A/dm^2$ is desirable in view of power loss due to an increase in the electrolytic voltage.

PREFERRED EMBODIMENTS OF THE INVENTION

The present invention will be explained in detail below, referring to Example.

EXAMPLE

Figure 2:
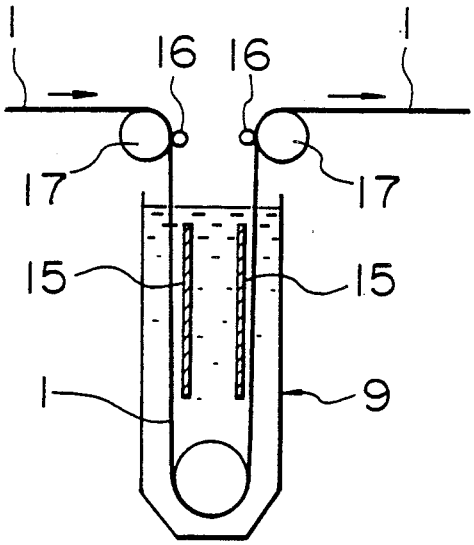
FIG. 2 is a vertical, cross-sectional view of one example of the conventional electrolytic treatment bath placed in the production line of FIG. 1.

In FIG. 1, a production line of one-side electrogalvanized steel sheet to which the present invention is applicable is schematically shown, where a steel sheet 1 continuously sent out of an uncoiler 2 is passed successively through a defatting tank 3, a water washing tank 4, a pickling tank 5 and a water washing tank 6 into a galvanizing thank 7, where a desired one-side electrogalvanization is carried out on the side to be galvanized of the steel sheet, and then passed through a water washing tank 8 into an electrolytic treatment tank 9, where a peeling treatment by electrolysis using the non-electrogalvanized side as an anode is carried out on the non-electrogalvanized side of the steel sheet. Then, the steel sheet is passed through a water washing tank 10 and a dryer 11 and wound into a coil by a recoiler 12. As the electrolytic treatment tank 9, the tank shown in FIG. 2 is used.

In the above-mentioned production line, steel sheets were treated according to the present invention as examples and the prior art as comparative examples. The one-side electrogalvanization was carried out in a galvanizing bath containing 200 g/l of $ZnSO_4.7H_2O$, 300 g/l of $NiSO_4.6H_2O$, 25 g/l of $H_2SO_4$ and 100 g/l of $Na_2SO_4$ at pH 1.0 and 60° C., and the deposition of galvanizing metals on the non-electrogalvanized side amounted to about 50 $mg/m^2$. The electrolytic peeling treatment was carried out by electrolysis, using the non-electrogalvanized side of the one-side electrogalvanized steel sheet as anode at a current density of 20 A/dm$^2$ for 3 seconds.

Evaluation of the appearances of non-electrogalvanized sides after the electrolytic peeling treatment is as follows:

Δ Blackening remains partially.

x Blackening remains.

Phosphate salt treatment was carried out with agents made by Nihon Parkerizing K.K., Japan under the following conditions.

A solution containing 16 g/l of FCL4410A and 12 g/l of FCL4410B as defatting agents was prepared and the steel sheets were defatted by spraying the thus prepared solution at 50° C. for 120 seconds and then washed with water. Another solution containing 1.5 g/l of PL-ZTH as a surface-conditioning agent was prepared, and the defatted steel sheets were sprayed with the thus prepared solution at room temperature and then dipped in a solution containing Bondelite L3020 as a chemical conversion treatment agent with a free acidity of 0.7 to 1.1 point, a total acidity of 22 to 24 points, an accelerator concentration of 2.5 to 3.5 points and a temperature of 42° C. for 120 seconds, and then the deposition amount and grain size of phosphate salt crystals were measured.

As given in Table, Case No. 1 shows the susceptibility of ordinary cold-rolled steel sheet to the phosphate salt treatment and the shown deposition amount and grain size are deemed to be acceptable standard levels. Case No. 2 shows the susceptibility of the non-electrogalvanized side of one-side electrogalvanized steel sheet, which is considerably poor, as compared with that of Case No. 1. Case Nos. 3 and 5 containing no and less pH-controlling agent, respectively, show a poor pH stability of the treatment bath and also show a poor appearance. Case No. 4 with less electroconductive agent shows a poor electroconductivity of the treating bath and cannot sufficiently obtain the effect on the improvement of the susceptibility to the phosphate salt treatment. Case No. 8 with more electroconductive agent shows a poor appearance. Case Nos. 6 and 9 outside the appropriate pH range show a poor susceptibility to the phosphate salt treatment. Case No. 12 using other agent than sodium sulfate shows a poor appearance and also a poor susceptibility to the phosphate salt treatment. On the other hand, Case Nos. 7, 10 and 11 according to the present invention shows a good appearance and a good susceptibility to the phosphate salt treatment, as compared with the above-mentioned Comparative Examples.

TABLE

| Case No. | Electrolytic peeling bath: Components (g/l) | | Stability: Initial pH | Stability: pH after current passage | Appearance of non-electrogalvanized side (steel matrix) after electrolytic peeling | Susceptibility to dip-type phosphate salt treatment: Deposition amount (g/m$^2$) | Susceptibility to dip-type phosphate salt treatment: Grain size (μm) | Remarks |
|---|---|---|---|---|---|---|---|---|
| 1 | — | — | — | — | ◎ | 2.0~2.5 | 5 | Comp. Ex. (ordinary cold-rolled steel sheet) |
| 2 | — | — | — | — | X | 3.0~4.0 | 10 | Comp. Ex. (one-side electrogalvanized steel sheet with no electrolytic peeling treatment) |
| 3 | $Na_2SO_4$ | 100 | 5 | 10 | X | 1.0~1.5 | 10 | Comp. Ex. |
| 4 | $Ha_2SO_4$<br>$H_3BO_3$ | 40<br>40 | 6 | 6 | ○ | 1.0~1.5 | 10 | Comp. Ex. |
| 5 | $Na_2SO_4$<br>$H_3BO_3$ | 100<br>0.5 | 6 | 10 | X | 1.0~1.5 | 10 | Comp. Ex. |
| 6 | $Na_2SO_4$<br>$H_3BO_3$ | 100<br>40 | 2 | 3 | Δ | 1.5~2.0 | 5 | Comp. Ex. |
| 7 | $Na_2SO_4$<br>$H_3BO_3$ | 100<br>40 | 6 | 6 | ◎ | 2.0~2.5 | 5 | The Invention |
| 8 | $Na_2SO_4$<br>$H_3BO_3$ | 400<br>40 | 6 | 6 | X | 1.5~2.0 | 5 | Comp. Ex. |
| 9 | $Na_2SO_4$<br>$H_3BO_3$ | 100<br>40 | 10 | 10 | Δ | 1.5~2.0 | 5 | Comp. Ex. |
| 10 | $Na_2SO_4$<br>$H_3BO_3$<br>Citric acid ($C_6H_8O_7.H_2O$) | 100<br>40<br>10 | 7 | 7 | ◎ | 2.0~2.5 | 5 | The Invention |
| 11 | $Na_2SO_4$<br>$H_3BO_3$<br>Tartaric acid ($C_4H_6O_6$) | 100<br>40<br>10 | 7 | 7 | ◎ | 2.0~2.5 | 5 | The Invention |
| 12 | NaCl<br>$H_3BO_3$ | 50<br>40 | 7 | 7 | Δ | 2.0~2.5 | 10 | Comp. Ex. |

What is claimed is:

1. A process for producing a one-side electrogalvanized steel sheet with a distinguished susceptibility to a phosphate salt treatment and a distinguished appearance on the non-electrogalvanized side, which comprises applying an electrogalvanizing treatment of zinc system to one side of a steel sheet in an electrogalvanizing bath of zinc system, washing the one-side electrogalvanized steel sheet with water, applying to the non-electrogalvanized side of the steel sheet a peeling treatment by electrolysis using the non-electrogalvanized side of the steel sheet as an anode at an anode current density of at least 2 A/dm$^2$ in an electrolytic peeling treatment bath, and washing the steel sheet with water, followed by drying, characterized in that the peeling treatment by electrolysis is conducted in an electrolytic peeling treatment bath containing 5 to 30% by weight of sodium sulfate as an electroconductive agent and at least 0.1% by weight of boric acid as a pH-controlling agent and having a pH adjusted to a range of 5.0 to less than 9.0.

2. A process according to claim 1, wherein the electrolytic peeling treatment bath further contains an organic acid as a chelating agent.

3. A process according to claim 2, wherein the organic acid is at least one member selected from the group consisting of citric acid, tartaric acid, oxalic acid, formic acid and lactic acid.

4. A process according to any of claims 1 to 3, wherein the electrolytic peeling treatment bath contains 0.1 to 20.0% by weight of the organic acid.

5. A process according to any of claims 1 to 3, wherein the electrolytic peeling treatment bath contains 0.5 to 10% by weight of the boric acid.

6. A process according to any of claims 1 to 3, wherein the electrolytic peeling treatment bath has a pH adjusted to a range of 5.2 to 7.5.

7. A process according to any of claims 1 to 3, wherein the pH is adjusted to a predetermined pH value in a range of 5.0 to less than 9.0.

8. A process according to any of claims 1 to 3, wherein the pH is adjusted to a predetermined pH value in a range of 5.2 to 7.5.

* * * * *